US006248451B1

(12) United States Patent
Smith

(10) Patent No.: US 6,248,451 B1
(45) Date of Patent: Jun. 19, 2001

(54) LEATHER SURROUND FOR DECORATIVE ARTICLES

(75) Inventor: K. Wayne Smith, Elkhorn, WI (US)

(73) Assignee: Bergamot Incorporated, Delavan, WI (US)

( * ) Notice: Subject to any disclaimer, the term of this patent is extended or adjusted under 35 U.S.C. 154(b) by 0 days.

(21) Appl. No.: 09/490,843

(22) Filed: Jan. 25, 2000

(51) Int. Cl.[7] ..... A47G 35/00

(52) U.S. Cl. ..... 428/542.2; 428/14; 428/64.1; 428/66.5; 428/66.6; 428/66.7; 70/456 R; 70/457; 40/634

(58) Field of Search ..... 428/14, 64.1, 66.5, 428/66.7, 66.6, 542.2; 70/456 R, 457; 40/634

(56) References Cited

U.S. PATENT DOCUMENTS 5,294,466 3/1994 Baughman ..... 428/14

*Primary Examiner*—Deborah Jones
*Assistant Examiner*—Abraham Bahta
(74) *Attorney, Agent, or Firm*—Foley & Lardner

(57) ABSTRACT

A leather surround for decorative articles of the type which could be used with key rings or as luggage tags, golf bag tags, and the like includes a pair of leather sheets, one of which includes an opening. A decorative article, such as a pictorial work or logo, is located in the opening. The decorative article is held in place by first stitching between the two leather sheets, a plastic mesh and by applying a liquid adhesive to attach the decorative article to the mesh. The decorative article is preferably made from a non-ferrous metal, such as pewter.

16 Claims, 1 Drawing Sheet

LEATHER SURROUND FOR DECORATIVE ARTICLES

CROSS-REFERENCES TO RELATED APPLICATIONS, IF ANY

None

BACKGROUND OF THE INVENTION

1. Field of the Invention

The present invention relates generally to the art of leather articles, such as leather fobs or tags used with duffle bags, luggage, golf bags, brief cases and the like. More specifically, the preferred embodiment of the present invention relates to a leather surround for metallic decorative articles, such as decorative articles made from pewter. Still more specifically, the present invention relates to a method of manufacturing such an article wherein the decorative article is firmly adhered within a leather surround by using a liquid adhesive to attach it to a plastic mesh sewn between sheets of leather.

2. Description of the Prior Art

Key fobs, bag tags, brief case tags, luggage tags and the like have been known for many years and have been prepared in a variety of sizes, shapes, and from a variety of different types of materials. Some of such devices have included combinations of different materials such as flat, painted metal sheets adhered to natural or synthetic leather using an adhesive. Leather does not adhere well to most adhesives due to the oils and surface textures of the leather, and alternative approaches have been employed, especially when the metal is expensive or where in the decoration of the sheet is itself is intricate and/or expensive. Because of the flexibility of leather, there has always been a tendency for the metal portion to break loose from the backing when an adhesive is used.

One solution to the above-noted problems is described in U.S. Pat. No. 5,294,466, entitled "Leather Surround For Decorative Articles" issued on Mar. 15, 1994 to one of the present inventors. In this patent, a technique is suggested wherein two leather sheets are stitched to one another, one of the leather sheets having an opening therein to receive the decorative article. The article described in this patent includes a flange surrounding at least a portion of its outer boundary and adapted to be received between the two sheets of leather. The stitching of the leather sheets preferably is provided immediately to the outside of the flange and, the patent suggests, that an adhesive may be used to assist in bonding the article and maintaining a desired orientation.

It is highly desirable in the creation of tags and fobs using relief pewter castings and the like to improve the aesthetic appeal and durability as much as possible. Because it is becoming increasingly common for consumers to personalize expensive accessories, the ability to prepare leather and metal combinations is becoming increasingly important. It is also becoming increasingly common to have consumers personalize articles and by-products, including artistically detailed displays, including relief images. Such images can be pictorial, graphic, corporate logos and/or combinations of the foregoing with information identifying the purchaser. As an example of the latter, it is relatively common to have the initials of a purchaser engraved in the article.

Regardless of the types of materials which have heretofore been used, when leather is employed as the main support for the decorative article, it has been necessary to employ an adhesive of some sort, and all adhesives known to the present inventors have a tendency to fail, resulting in reduced aesthetics and potential loss of the decorative article itself. It would be highly desirable to provide a surround for a decorative article which could be in the form of a leather tag or fob, and in which the article is securely attached.

FEATURES AND SUMMARY OF THE INVENTION

A primary feature of the present invention is to provide a leather surround for decorative articles which overcomes the manufacturing and security defects of the prior art.

Another feature of the present invention is to provide a leather surround for decorative articles which may be made in a variety of shapes and sizes.

Another feature of the present invention is to provide a manufacturing technique for preparing leather surrounds for decorative articles which eliminates the need to provide a flange around the article itself.

A different feature of the present invention is to provide a leather surround for decorative articles in which final assembly may be conducted at a location different from that where the leather sheets are sewn together, and which will permit the leather surround inventories to be manufactured before orders are received for the decorative articles themselves.

Yet a further feature of the present invention is to provide an inexpensive and reliable manufacturing method for preparing leather surrounds for decorative articles.

How these and further features of the present invention are accomplished will be described in the following Detailed Description of the Preferred Embodiment taken in conjunction with the FIGURES. Generally, however, they are provided by providing a first leather sheet and a second leather sheet having an opening therein sized to contain the decorative article. The two sheets are sandwiched about a plastic mesh and are sewn together so that the mesh is captured by the stitching. A decorative article, which can be made from pewter or other materials, is subsequently placed within the opening in the second leather sheet after an adhesive is added to the mesh which couples the rear surface of a decorative article to the mesh. In the most preferred embodiment, the mesh is nylon and the adhesive is a cyanoacrylate. Other ways in which the features of the present invention are accomplished will become apparent to those skilled in this art after they have reviewed this specification. Such other ways are deemed to fall within the scope of the present invention if they fall within the scope of the claims which follow.

DESCRIPTION OF THE DRAWINGS

In the various FIGURES, like reference numerals are used to indicate like components.

DETAILED DESCRIPTION OF THE PREFERRED EMBODIMENT

Figure 1:
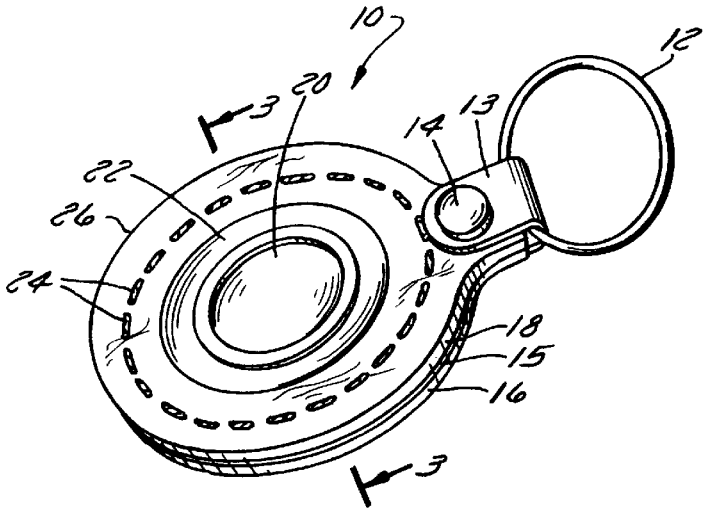
FIG. 1 is a perspective view of a key ring fob prepared according to the most preferred form of the present invention.

Before beginning the detailed description of the preferred embodiment, several general comments are warranted about the applicability and scope of the present invention.

First, while pewter or other metal alloy castings are illustrated for use with the preferred embodiment, the invention has applicability to other metals, metal alloys, plastics, and other materials which have heretofore been difficult to adhere to leather using an adhesive only. Furthermore, the preferred decorative material is a tin-based alloy, such as pewter, but other non-ferrous metals such as zinc alloys or metals such as zinc, aluminum, brass, silver, gold plate or gold could be used, without departing from the intended scope of the invention.

Second, while the decorative article illustrated in the preferred embodiment does not include a flange such as that described in the aforementioned U.S. Pat. No. 5,294,466, the decorative article may include the flange as further security for retaining the decorative article within the surround. In this vein, the entire disclosure of this patent is expressly incorporated herein, by this reference.

Third, the preferred mesh material is a 100% nylon, 60 pound per thousand square foot nylon mesh, manufactured by 3-M Company, model #889, XF, black finish. The preferred glue is also manufactured by the 3-M Company's, Adhesives, Coatings & Sealers Division, is St. Paul, Minn. 55144. The product used in the preferred embodiment is Pronto CA100, instant adhesive, which is identified by the manufacturer as being a cyanoacrylate adhesive. What is important to understand for purposes of this section of the specification is that other mesh and adhesive materials may be readily selected by those skilled in the art once they understand that the criteria are that the adhesive bond to both the mesh and to the decorative article. It is not necessary for the adhesive to form any significant bond to the leather.

Fourth, while stitching is the preferred technique used to lock the mesh material beneath the opening of a leather sheet, other fastening techniques such as stapling, nailing and the like can be employed. It is also not necessary when using stitching to totally surround the decorative article, although it is usually desired for aesthetic purposes. The important objective is to attach the mesh in a position in which it covers at least a portion of one sheet of leather beneath the opening in the other leather sheet, so that an adhesive may be used to attach the decorative article to the mesh.

Fifth, the present invention is illustrated in connection with a key fob attached to a key ring by a leather strap, but the invention has much wider applicability for use in other applications such as luggage tags, bag tags (for example, golf bag tags), for brief case or hand bag tags and the like. The oval design for the decorative article can be widely varied and the shape is, in and of itself, unimportant to the present invention. Furthermore, the type of decorative design used for the decorative article can vary widely from complex relief designs to simple identifying information, such as initials, painted or otherwise affixed to the exposed surface of the decorative article.

Finally, leather is the preferred material for use in the present invention, and the leather may be synthetic or natural. Other materials could, however, be used as long as the mesh/adhesive/decorative article compatibility mentioned above are present.

Figure 3:
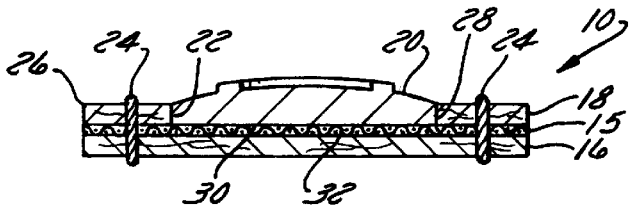
FIG. 3 is a cross-section taken along the line 3—3 of FIG. 1.
Figure 2:
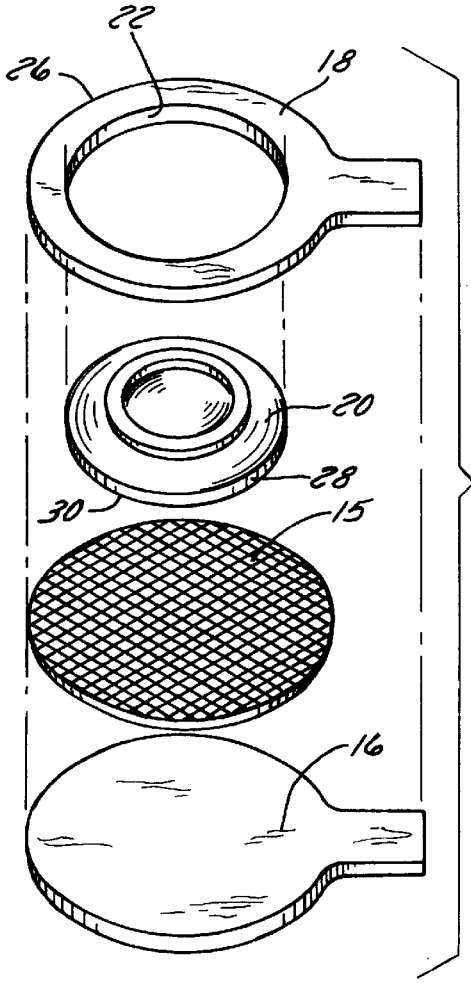
FIG. 2 is an exploded view of the major components of the fob shown in FIG. 1 and illustrating the upper and lower leather sheets, a mesh sheet and the decorative article.

Proceeding now to a description of FIG. 1, which should be viewed in conjunction with FIGS. 2 and 3, a key fob 10 is shown attached to a key ring 12 by a short leather strap 13. The latter is folded over the ring and held to the fob by a brad 14. The fob could also include a protrusion (not shown) through which a hole could be provided for attachment of the ring 12.

Fob 10 is comprised of four major components, shown best in FIG. 2 including a lower leather sheet 16, an upper leather sheet 18, a decorative article 20 and a sheet of mesh material 15. Lower sheet 16 is planar, while upper sheet 18 includes an opening 22 adapted to surround the decorative article 20. The fob 10 also includes stitching 24 around the decorative article which holds the sheets 16 and 18 against one another and anchors the mesh sheet 15. The stitching 24 is located between the outer edge 26 of fob 10 and the opening 22, the location being less critical in this invention than in the aforementioned U.S. Pat. No. 5,294,466.

When attention is next directed to FIGS. 2 an 3, it will be noted that the decorative article includes an outer edge 28 extending around its periphery (further distinguishing this invention from the prior invention where a flange was located around the decorative article). The decorative article 20 is sized to fit within the opening 22 and includes a planar rear surface 30 adapted to contact the mesh sheet 15.

Also visible in FIG. 3 is an adhesive 32 extending across the rear surface 30 of decorative article 20 and penetrating the openings of the mesh sheet 15. As previously mentioned, the adhesive is selected to firmly bond with the mesh sheet 15 and with the material used for the decorative article 20. The particular class of adhesive (thermoset, thermoplastic, etc.) and the number of components used to prepare the liquid adhesive are not important, the required criteria being the ability to bond the decorative article 20 material to the mesh sheet 15.

Referring once again to stitching 24, it can now be appreciated that it can be located anywhere between the outer edge 28 of the decorative article and the outer edge 26 of fob 10. Most preferably, the stitching is located at least one-eighth of an inch (⅛") from the outer edge 28 of the decorative article 20 and from the outer edge 26 of fob 10.

The fob of the present invention is made in a manufacturing process which starts with the selection and sizing of sheets 16 and 18 and the sewing together thereof about the mesh sheet 15. The casting or other method for preparing decorative article 20 may take place at the same location or at a different location from that used to prepare the leather/mesh combination. Final assembly is accomplished by adding the liquid adhesive 32 to the cavity formed by opening 22, preferably smoothly covering the mesh 15 and extending above mesh sheet 15 by a sufficient amount to uniformly coat and adhere to the back 30 of decorative article 20. Because final assembly involves only the application of adhesive and insertion of the decorative article 20, manufacturing inefficiencies inherent in the previously mentioned U.S. Pat. No. 5,294,466 are avoided. This is because in the prior manufacturing process it was necessary to have the finished decorative article 20 at the location where the sewing step was conducted. Inventory imbalances resulting from the prior manufacturing process resulted in manufacturing cost increases and unavoidable delays.

While the present invention has been described in connection with a particular preferred embodiment, the invention is not to be limited thereby but is to be limited solely by the scope of the claims which follow.

What is claimed is:

1. A decorative article and a surround therefor comprising:

a decorative article having an outer perimeter, a rear surface, and a front decorative surface;

a first sheet larger than the decorative article and having a first planar surface;

a mesh overlying the first planar surface;

a second sheet larger than the decorative article, the second sheet including a second planar surface and an opening therethrough corresponding approximately in size to the outer perimeter of the decorative article;

stitching securing the first sheet to the second sheet and fixing the mesh in place between the two sheets; and an adhesive contacting at least the rear surface of the decorative article and the mesh.

2. The invention of claim 1 wherein the mesh is made from nylon.

3. The invention of claim 1 wherein the first and second sheets are selected from the group consisting of natural and synthetic leathers.

4. The invention of claim 3 wherein the first and second sheets are each natural leather.

5. The invention of claim 1 wherein the decorative article is made from a material selected from the group consisting of non-ferrous metals and non-ferrous metal alloys.

6. The invention of claim 1 wherein the decorative article is a pewter casting.

7. The invention of claim 1 wherein at least a portion of the front surface of the decorative article is painted.

8. The invention of claim 1 wherein the mesh is nylon and the adhesive is a cyanoacrylate adhesive.

9. The invention of claim 1 where the adhesive is selected from the group of adhesives capable of bonding to both the mesh and the decorative article.

10. A method for manufacturing a decorative article and a surround therefore comprising the steps of:

providing a first sheet having an upper surface;

placing a mesh over the upper surface of the first sheet;

placing a second sheet over the mesh, the second sheet having an opening therethrough to receive a decorative article;

attaching the first sheet to the second sheet to affix the mesh therebetween;

placing an adhesive on the exposed portion of the mesh; and placing a decorative article in the opening so that a portion thereof contacts the adhesive.

11. The method of claim 10 wherein the attaching step is accomplished by stitching.

12. The method of claim 10 wherein both sheets are made from leather.

13. The method of claim 10 wherein the mesh is a nylon mesh and the adhesive is a cyanoacrylate adhesive.

14. The method of claim 10 wherein the decorative article is a pewter casting, the mesh is a nylon mesh and the adhesive is a cyanoacrylate adhesive.

15. The method of claim 10 wherein the placement of the decorative article in the opening occurs after the attaching step.

16. The method of claim 10 wherein the decorative article includes an outwardly extending flange to be captured between the two sheets and wherein the placement of the decorative article against the mesh and the adhesive precedes the attaching step.

* * * * *